US011552414B2

(12) United States Patent
Qiu et al.

(10) Patent No.: US 11,552,414 B2
(45) Date of Patent: Jan. 10, 2023

(54) GROUNDING SEGMENT FOR SEGMENTED GROUNDING ELECTRIC DEVICE

(71) Applicant: SOUTH CHINA SEA INSTITUTE OF OCEANOLOGY, CHINESE ACADEMY OF SCIENCES, Guangzhou (CN)

(72) Inventors: Ning Qiu, Guangzhou (CN); Zhen Sun, Guangzhou (CN)

(73) Assignee: SOUTH CHINA SEA INSTITUTE OF OCEANOLOGY, CHINESE ACADEMY OF SCIENCES, Guangzhou (CN)

( * ) Notice: Subject to any disclaimer, the term of this patent is extended or adjusted under 35 U.S.C. 154(b) by 0 days.

(21) Appl. No.: 17/627,130

(22) PCT Filed: Jul. 20, 2021

(86) PCT No.: PCT/CN2021/107319

§ 371 (c)(1),
(2) Date: Jan. 14, 2022

(87) PCT Pub. No.: WO2021/249573

PCT Pub. Date: Dec. 16, 2021

(65) Prior Publication Data

US 2022/0271446 A1 Aug. 25, 2022

(30) Foreign Application Priority Data

Aug. 4, 2020 (CN) ..... 202010772388.2

(51) Int. Cl.
*H01R 4/48* (2006.01)
*H01R 4/64* (2006.01)

(52) U.S. Cl.
CPC ..... *H01R 4/489* (2013.01); *H01R 4/64* (2013.01)

(58) Field of Classification Search
CPC ..... H01R 4/489; H01R 4/64
See application file for complete search history.

(56) References Cited

U.S. PATENT DOCUMENTS 8,864,504 B1 10/2014 Gretz et al.

FOREIGN PATENT DOCUMENTS

CN 108376948 A 8/2018
CN 108599081 A 9/2018
(Continued)

*Primary Examiner* — Carl J Arbes
(74) *Attorney, Agent, or Firm* — Bayramoglu Law Offices LLC

(57) ABSTRACT

A grounding segment for a segmented grounding electric device, including a plurality of segment single bodies disposed in a matched manner, wherein a curved concave surface is formed in an outer side surface of each segment single body; a chute is formed in the curved concave surface; an interior of the chute is in sliding connection with an elastic member; two ends of the elastic member are respectively connected to sliders; the sliders are in sliding connection with the interior of the chute; each slider is movably connected to a curved fixing member matching a grounding conductor; the curved fixing member is made of a conductive material applicable to grounding conductors of different sizes; and a locking apparatus is connected between the plurality of segment single bodies. A user conveniently transports and mounts the grounding segment to reduce a land excavation area. Universality of the grounding segment is improved.

6 Claims, 4 Drawing Sheets

(56) References Cited

FOREIGN PATENT DOCUMENTS

| | | | | |
|---|---|---|---|---|
| CN | 208062268 | U | | 11/2018 |
| CN | 109786990 | A | * | 5/2019 |
| CN | 209544637 | U | * | 10/2019 |
| CN | 209881098 | U | | 12/2019 |
| CN | 209994012 | U | | 1/2020 |
| CN | 210167754 | U | | 3/2020 |
| CN | 210806029 | U | | 6/2020 |
| CN | 112072338 | A | | 12/2020 |

* cited by examiner

GROUNDING SEGMENT FOR SEGMENTED GROUNDING ELECTRIC DEVICE

CROSS REFERENCE TO THE RELATED APPLICATIONS

This application is the national stage entry of International Application No. PCT/CN2021/107319, filed on Jul. 20, 2021, which is based upon and claims priority to Chinese Patent Application No. 202010772388.2 filed on Aug. 4, 2020, the entire contents of which are incorporated herein by reference.

TECHNICAL FIELD

The present invention relates to the technical field of lightning protection, and specifically to a grounding segment for a segmented grounding electric device.

BACKGROUND

A grounding apparatus of a transmission line is a basic guarantee and an important measure to maintain safe and reliable operation of an electric device and guarantee safety of the electric device and an operating person. The grounding apparatus includes a grounding body and a grounding line. In addition, the grounding body good in impact characteristic can play a role in lightning protection by leading lightning current into the ground, thereby effectively protecting the transmission line, and further avoiding a power outage caused by a lightning strike. This has great significance to safe operation and power supply reliability of the electric device.

When an existing grounding segment is mounted and connected to a grounding conductor, because the size of the grounding segment is greater than that of the grounding conductor, an excavation area in mounting construction is relatively large, which goes against environmental protection. In addition, the grounding segment is inapplicable to grounding conductors of different sizes, and universality of the grounding segment is relatively poor.

SUMMARY

To overcome deficiencies in the prior art, the objective of the present invention is to provide a grounding segment for a segmented grounding electric device, which reduces an excavation area and has improved universality.

To implement the foregoing objective, the present invention provides the following technical solutions.

A grounding segment for a segmented grounding electric device is provided, and includes several segment single bodies that are disposed in a matched manner, wherein a curved concave surface is formed in the outer side surface of each segment single body; a chute is formed in the curved concave surface; the interior of the chute is in sliding connection with an elastic member; two ends of the elastic member are respectively connected to sliders; the sliders are in sliding connection with the interior of the chute; each slider is movably connected to a curved fixing member that matches a grounding conductor; the curved fixing member is made of a conductive material applicable to grounding conductors of different sizes; and a locking apparatus is connected between the segment single bodies.

According to the foregoing technical solution, the locking apparatus is connected between segment single bodies, thereby connecting the several segment single bodies into an entire grounding segment. The segment single bodies are mounted and demounted by using the locking apparatus, thereby splitting the grounding segment. In this way, a user can conveniently transport and mount the grounding segment. In addition, during mounting, because the size of the segment single body is smaller than that of the entire grounding segment, the segment single body can be buried in the ground more conveniently, thereby reducing a land excavation area, and further reducing excavation workload of a working person. Because each slider is movably connected to the curved fixing member that matches the grounding conductor, when the several segment single bodies are clamped on the exterior of the grounding conductor by using the locking apparatus, as the locking apparatus is tightened, the curved fixing member and the grounding conductor mutually squeeze each other, thereby causing the curved fixing member to deform gradually. Accordingly, the slider and the elastic member move at the same time, thereby playing a role in adjusting the position of the curved fixing member, and making the curved fixing member fit the grounding conductor more tightly. Meanwhile, because the curved fixing member is in sliding connection with the slider, flexibility of the curved fixing member is improved, thereby enabling the curved fixing member to be applicable to grounding conductors of different sizes, and improving universality of the grounding segment. As the grounding conductor is made of a conductive material applicable to grounding conductors of different sizes, charges of the grounding conductor can be transferred to the segment single body. Meanwhile, the radian of the curved fixing member can be changed easily, so that the curved fixing member can be applicable to grounding conductors of different sizes.

The present invention is further set as follows: the chute is formed in the middle of the curved concave surface, wherein the chute and the curved concave surface are disposed in parallel.

According to the foregoing technical solution, the chute is formed in the middle of the curved concave surface, so that stress on the segment single body is more uniform, thereby improving reliability of the connection between the curved fixing member and the grounding conductor. In addition, the chute and the curved concave surface are disposed in parallel, so that during mounting of the segment single body, all the several curved fixing members are disposed on the same horizontal plane, thereby enabling the curved fixing members to clamp the grounding conductor more firmly, and improving the reliability of the grounding segment.

The present invention is further set as follows: during mounting of the segment single body, the length of the projection of the chute in the horizontal direction and the length of the projection of the curved concave surface are disposed to be the same.

According to the foregoing technical solution, a stroke range of the slider is enlarged, and the flexibility of the segment single body is improved, thereby improving the adaptability of the grounding segment.

The present invention is further set as follows: an elastic fixing piece used for fixing the elastic member is disposed in the middle of the chute.

According to the foregoing technical solution, a phenomenon that the elastic member moves off the chute is avoided, thereby improving the stability of the grounding segment.

The present invention is further set as follows: two ends of the chute are fixedly connected to baffles used for limiting sliding in the chute.

According to the foregoing technical solution, the slider is prevented from moving off the chute, thereby ensuring that the slider can slide along the chute, and improving the moving stability of the slider.

The present invention is further set as follows: the locking apparatus includes a through hole penetrating two ends of the segment single body, wherein adjacent segment single bodies are connected by threading a locking bolt through the through hole.

According to the foregoing technical solution, the several segment single bodies are connected into an entire grounding segment, and the segment single bodies are mounted and demounted by using the locking apparatus, thereby splitting the grounding segment. A user can conveniently transport and mount the grounding segment. In addition, during mounting, because the size of the segment single body is smaller than that of the entire grounding segment, the segment single body can be buried in the ground more conveniently, thereby reducing a land excavation area, and further reducing excavation workload of a working person.

The present invention is further set as follows. The curved fixing member is made of spring steel.

According to the foregoing technical solution, spring steel is characterized by working under dynamic load, that is, under the condition of impact and vibration, or under the action of alternating stress, and spring steel has enough toughness and plasticity, thereby preventing a sudden brittle fracture under the action of pressure and improving the reliability of the grounding segment.

In summary, the present invention has the following beneficial effects.

1. The locking apparatus is connected between segment single bodies, thereby connecting the several segment single bodies into an entire grounding segment. The segment single bodies are mounted and demounted by using the locking apparatus, thereby splitting the grounding segment. In this way, a user can conveniently transport and mount the grounding segment. In addition, during mounting, because the size of the segment single body is smaller than that of the entire grounding segment, the segment single body can be buried in the ground more conveniently, thereby reducing a land excavation area, and further reducing excavation workload of a working person.

2. Because each slider is movably connected to the curved fixing member that matches the grounding conductor, when the several segment single bodies are clamped on the exterior of the grounding conductor by using the locking apparatus, as the locking apparatus is tightened, the curved fixing member and the grounding conductor mutually squeeze each other, thereby causing the curved fixing member to deform gradually. Accordingly, the slider and the elastic member move at the same time, thereby playing a role in adjusting the position of the curved fixing member, and making the curved fixing member fit the grounding conductor more tightly. Meanwhile, because the curved fixing member is in sliding connection with the slider, flexibility of the curved fixing member is improved, thereby enabling the curved fixing member to be applicable to grounding conductors of different sizes, and improving universality of the grounding segment.

Reference signs: 1—segment single body; 2—curved concave surface; 3—chute; 31—elastic member; 32—slider; 33—elastic fixing piece; 34—baffle; 4—curved fixing member; 5—through hole; and 6—locking apparatus.

DETAILED DESCRIPTION OF THE EMBODIMENTS

The present invention is further described in detail below with reference to the accompanying drawings and embodiments.

Figure 1:
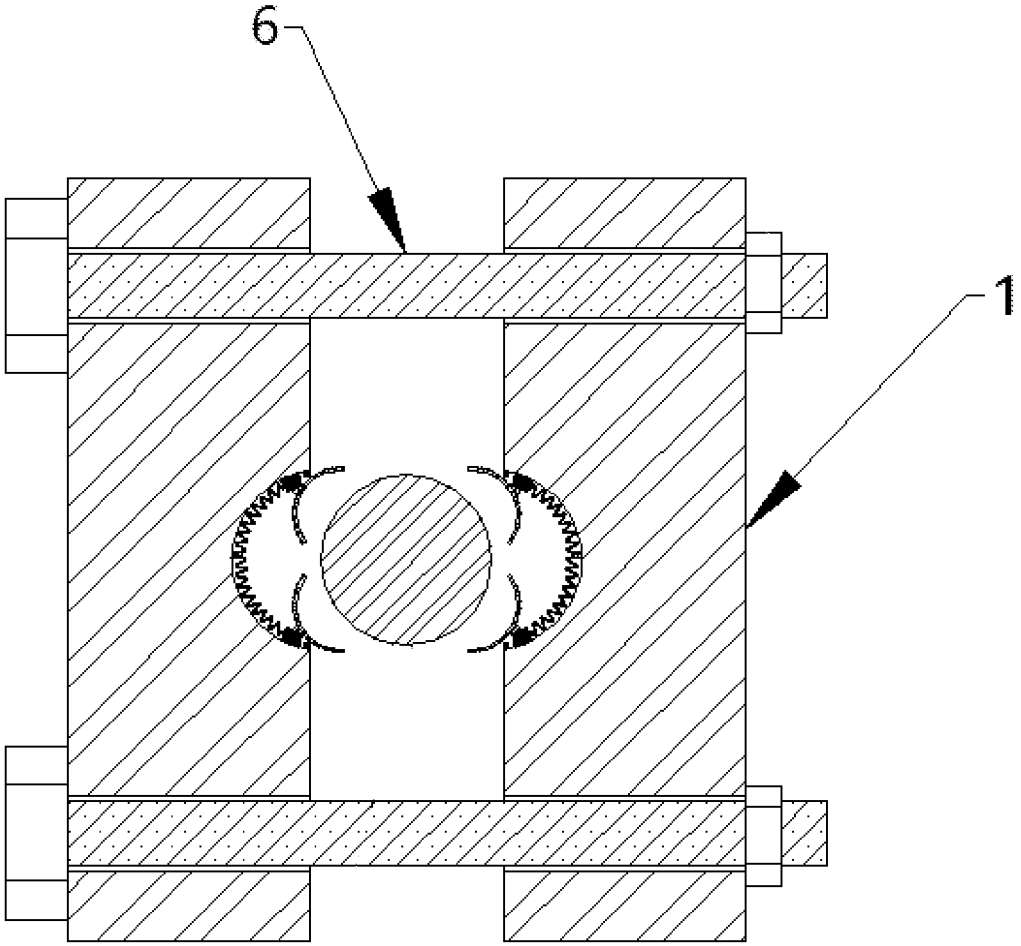
FIG. 1 is a schematic diagram of an entire structure according to an embodiment.
Figure 2:
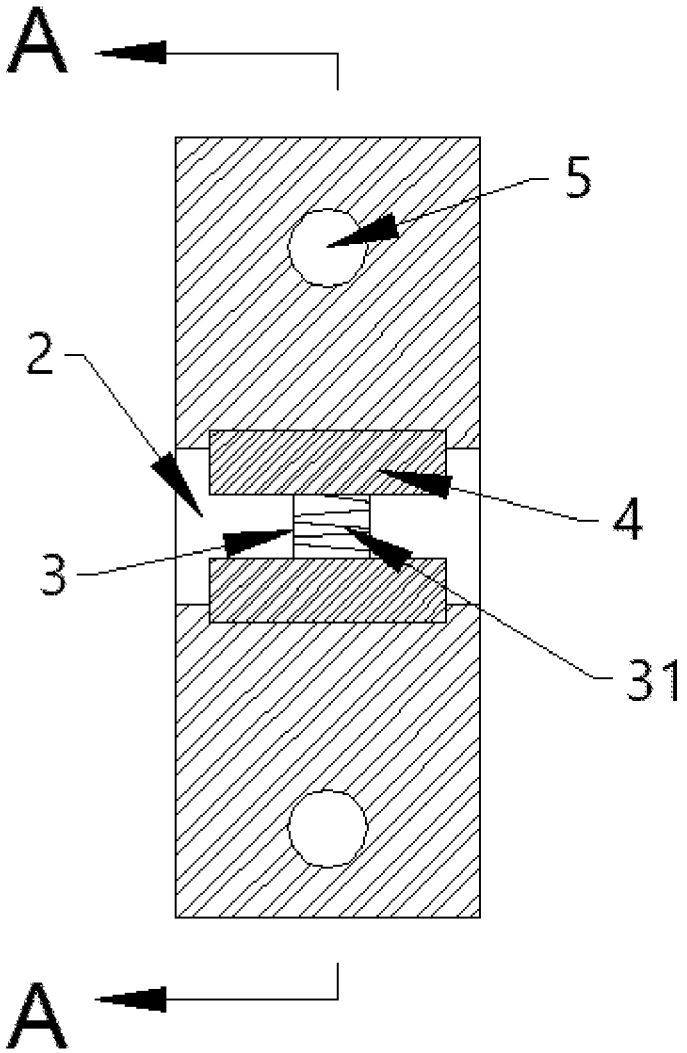
FIG. 2 is a schematic diagram of connection between a segment single body and a curved fixing member according to an embodiment.
Figure 3:
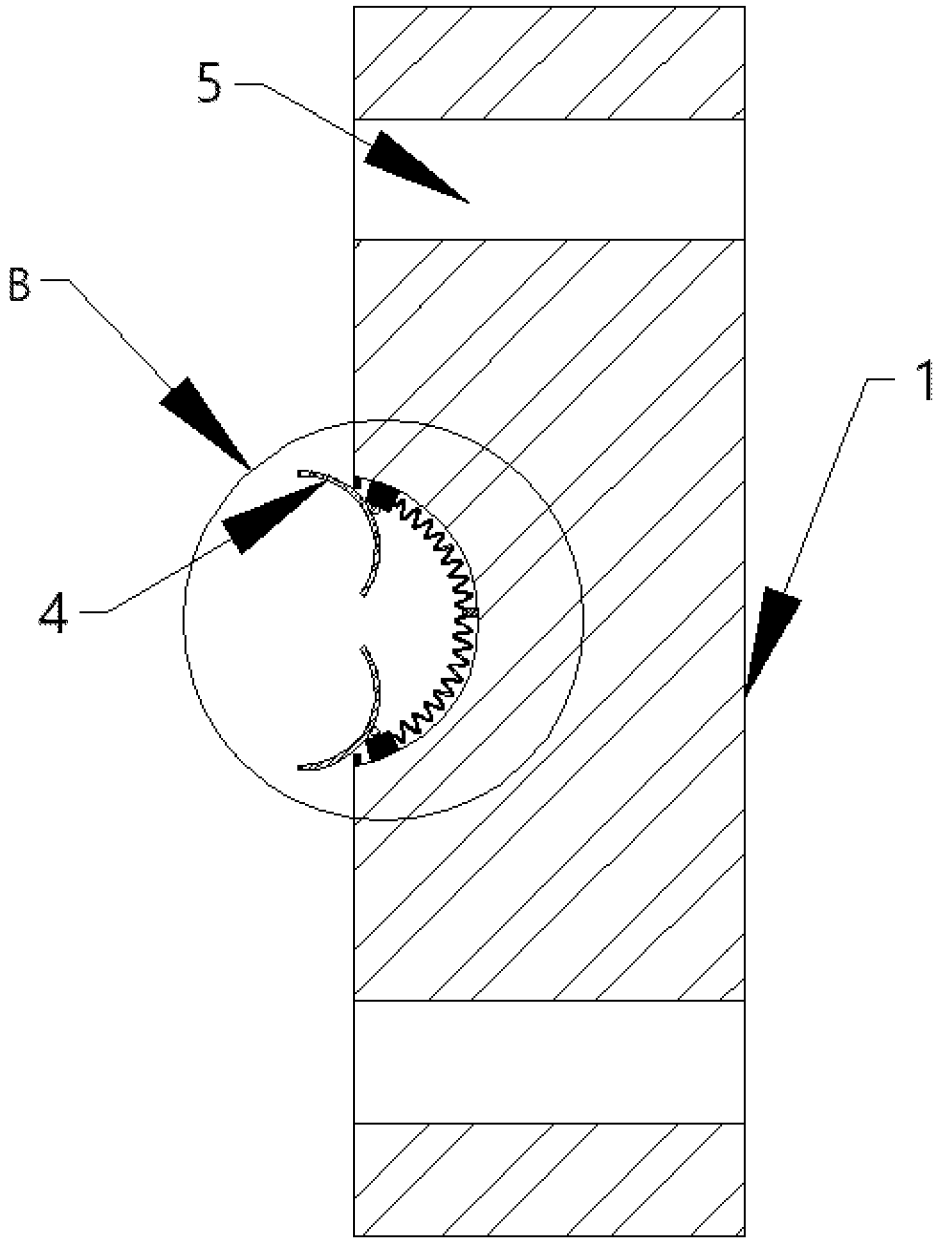
FIG. 3 is a sectional view of A-A in FIG. 2.
Figure 4:
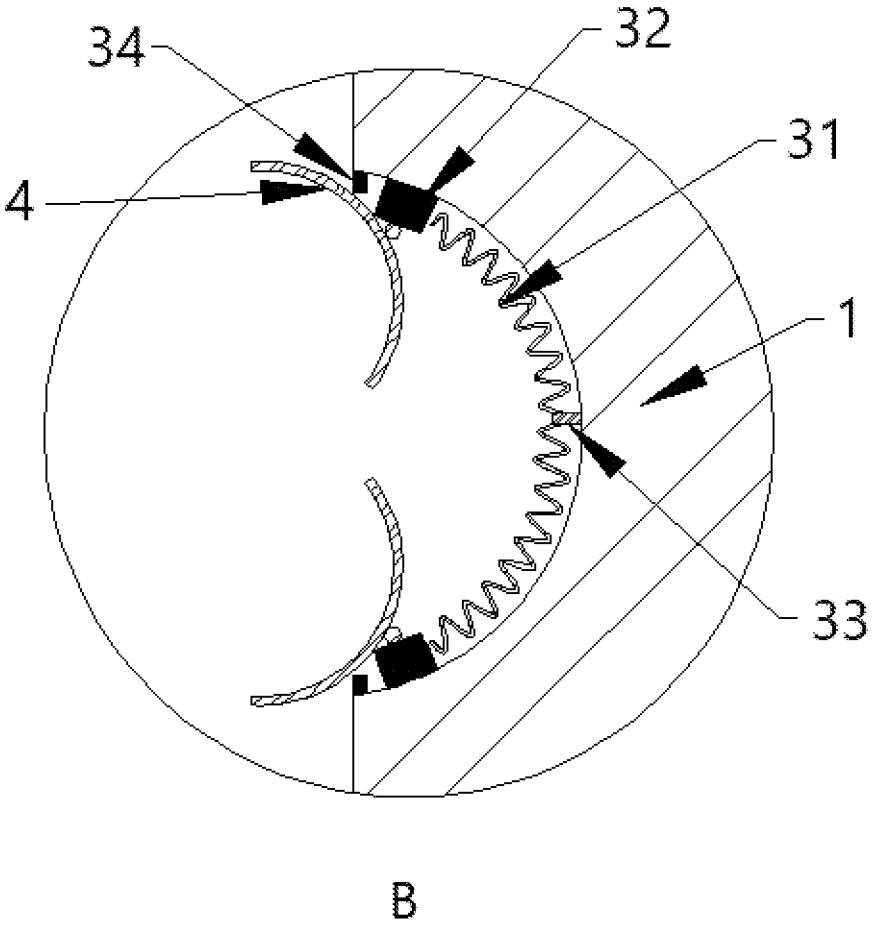
FIG. 4 is an enlarged diagram of part B in FIG. 3.

As shown in FIG. 1 and FIG. 2, the present invention discloses a grounding segment for a segmented grounding electric device, including two groups of segment single bodies 1 that are disposed in a matched manner. A locking apparatus 6 playing a role in connection is mounted between the two groups of segment single bodies 1. The locking apparatus 6 includes a through hole 5 penetrating two ends of the segment single body 1. The two groups of segment single bodies 1 are fixedly connected by threading a locking bolt through the through hole 5. A curved concave surface 2 is formed in the outer side surface of each segment single body 1. A chute 3 is formed in the curved concave surface 2. The interior of the chute 3 is in sliding connection with an elastic member 31. The elastic member 31 is a compression spring. As shown in FIG. 3 and FIG. 4, two ends of the elastic member 31 are respectively connected to sliders 32. Each slider 32 is in sliding connection with the interior of the chute 3. The outer side surface of each slider 32 is hinged to a curved fixing member 4 that matches a grounding conductor.

As shown in FIG. 2 and FIG. 4, a cross section of the chute 3 is T-shaped. The chute 3 is formed in the middle of the curved concave surface 2. The chute 3 and the curved concave surface 2 are disposed in parallel. During mounting of the segment single body 1, the length of the projection of the chute 3 in the horizontal direction and the length of the projection of the curved concave surface 2 are disposed to be the same. The length of the projection of the chute 3 in the vertical direction and the width of the projection of the curved fixing member 4 in the vertical direction are disposed to be the same.

The curved fixing member 4 is made of conductive spring steel. The thickness of the curved fixing member 4 is 2 to 4 mm. A nock of the curved fixing member 4 faces one end distal from the slider 32.

An elastic fixing piece 33 used for fixing the elastic member 31 is fixedly connected to the middle of the chute 3. Two ends of the chute 3 are fixedly connected to baffles 34 used for limiting sliding in the chute 3.

A working condition and principle of the embodiments are as follows.

During application of a grounding segment used in a segmented grounding body, two segment single bodies 1 are clamped on the exterior of a grounding conductor. A locking bolt is threaded through a through hole 5 to gradually tighten the two groups of segment single bodies 1. In a tightening process, a curved fixing member 4 deforms under an extrusion force of the grounding conductor, thereby being gradually stretched to clamp the grounding conductor. The slider 32 slides along with the curved fixing member 4, and the elastic member 31 is compressed, so that a joint area between the curved fixing member 4 and the grounding conductor is larger. The elastic member 31 is compressed and provides a reaction force for the slider 32, so that the curved fixing member 4 fits the grounding conductor tightly. Both the curved fixing member 4 and the slider 32 are conductors, thereby transferring chargers on the grounding conductor to the segment single body 1. The grounding segment adopts a split structure, thereby being relatively convenient to transport and mount. During mounting, because the size of the segment single body 1 is smaller than that of an entire grounding segment, the grounding segment can be conveniently buried in the ground for mounting, thereby reducing an excavation area. Meanwhile, the flexibility of the curved fixing member 4 is improved, thereby enabling the curved fixing member 4 to be applicable to grounding conductors of different sizes, and improving the universality of the grounding segment.

The above embodiments are merely used to illustrate the technical concept and characteristics of the present disclosure, are intended to make those of ordinary skill in the art understand the content of the present invention and implement the present invention based on the content, and should not limit the protection scope of the present disclosure. Any equivalent change or modification figured out based on the essence of the content of the present invention shall fall within the protection scope of the present disclosure.

What is claimed is:

1. A grounding segment for a segmented grounding electric device, comprising a plurality of segment single bodies disposed in a matched manner, wherein a curved concave surface is formed in an outer side surface of each of the plurality of segment single bodies; a chute is formed in the curved concave surface; an interior of the chute is in sliding connection with an elastic member; the elastic member is located on and in parallel to the curved concave surface, and the elastic member expands and contracts along the curved concave surface; two ends of the elastic member are respectively connected to sliders; the sliders are in sliding connection with the interior of the chute; each of the sliders is movably connected to a curved fixing member matching a grounding conductor; the curved fixing member is made of a conductive material applicable to grounding conductors of different sizes; and a locking apparatus is connected between the plurality of segment single bodies.

2. The grounding segment according to claim 1, wherein the chute is formed in a middle of the curved concave surface; and the chute and the curved concave surface are disposed in parallel.

3. The grounding segment according to claim 1, wherein an elastic fixing piece for fixing the elastic member is disposed in a middle of the chute.

4. The grounding segment according to claim 1, wherein two ends of the chute are fixedly connected to baffles for limiting sliding in the chute.

5. The grounding segment according to claim 1, wherein the locking apparatus comprises a through hole penetrating two ends of each of the plurality of segment single bodies; and adjacent segment single bodies are connected by threading a locking bolt through the through hole.

6. The grounding segment according to claim 1, wherein the curved fixing member is made of a spring steel.

* * * * *